US010806957B2

(12) United States Patent
Gutierrez

(10) Patent No.: US 10,806,957 B2
(45) Date of Patent: Oct. 20, 2020

(54) BOTTOMLESS POLE VAULT TRAINING BOX

(71) Applicant: Daniel H. Gutierrez, La Selva Beach, CA (US)

(72) Inventor: Daniel H. Gutierrez, La Selva Beach, CA (US)

( * ) Notice: Subject to any disclaimer, the term of this patent is extended or adjusted under 35 U.S.C. 154(b) by 101 days.

(21) Appl. No.: 15/986,993

(22) Filed: May 23, 2018

(65) Prior Publication Data

US 2019/0358481 A1 Nov. 28, 2019

(51) Int. Cl.

| | |
|---|---|
| ***A63B 5/06*** | (2006.01) |
| ***A63B 5/16*** | (2006.01) |
| ***A63B 24/00*** | (2006.01) |

(52) U.S. Cl.

CPC ..... *A63B 5/06* (2013.01); *A63B 5/16* (2013.01); *A63B 24/0062* (2013.01); *A63B 2220/30* (2013.01); *A63B 2220/40* (2013.01); *A63B 2220/62* (2013.01); *A63B 2220/805* (2013.01); *A63B 2220/833* (2013.01); *A63B 2225/52* (2013.01); *A63B 2244/085* (2013.01)

(58) Field of Classification Search

CPC ..... A63B 5/06; A63B 5/16; A63B 24/0062; A63B 2220/30; A63B 2220/40; A63B 2220/62; A63B 2220/805; A63B 2220/833; A63B 2225/52; A63B 2244/085; A63B 2005/085; A63B 24/0003; A63B 71/02; A63B 2210/10; A63B 2225/20; A63B 2225/50; A63B 2244/08

USPC ..... 473/FOR. 100, 125, 126

See application file for complete search history.

(56) References Cited

U.S. PATENT DOCUMENTS

| | | | | |
|---|---|---|---|---|
| 3,948,514 | A * | 4/1976 | Von Holt | A63B 5/06 482/18 |
| 4,163,551 | A | 8/1979 | Simpson | |
| 9,539,457 | B2 * | 1/2017 | Schwartz | A63B 5/06 |
| 9,566,462 | B2 * | 2/2017 | Schwartz | A63B 71/0054 |
| 9,616,265 | B2 * | 4/2017 | Johnson | A63B 5/06 |
| 2014/0135177 | A1 * | 5/2014 | Schwartz | A63B 5/06 482/18 |
| 2018/0093160 | A1 * | 4/2018 | Alhadeff | A63B 71/0622 |

OTHER PUBLICATIONS

Pole Vault Technical Errors, Brian Mackenzie, Oct. 2007 (Year: 2007).*

Track and Field Regulations, NCAA, Sep. 2015 (Year: 2015).*

Sensors for Mechatronics, Paul P.L. Regtien, Jan. 2015 (Year: 2015).*

* cited by examiner

*Primary Examiner* — Loan B Jimenez
*Assistant Examiner* — Kathleen Vermillera
(74) *Attorney, Agent, or Firm* — Soquel Group LLC

(57) ABSTRACT

Embodiments of the subject invention are directed to a training box or device used by an athlete to practice pole vaulting. The interior region of the training box is open, i.e. the base of the training box does not cover the interior of the device and thus there is no front edge. This invention is used to teach and train athletes pole vaulters who prefer to slide their vaulting poles on the ground instead using the prevailing method which involves carrying a pole as they run towards the box and placing the tip of the pole inside the training box. The training box may include electronics capability for measuring performance characteristics of pole vaulters such as the average speed of a pole.

14 Claims, 3 Drawing Sheets

BOTTOMLESS POLE VAULT TRAINING BOX

BACKGROUND

Field of Art

This description generally relates to the field of pole vaulting. The invention is especially useful as a training box used in the training of pole vaulters.

Background of this Invention

Pole vaulters typically train using training boxes to train for pole vaulting competitions. Training box sizes and shapes typically approximate the size and shape of boxes that are mounted in the ground and used for track and field competitions. However, pole vault boxes are mounted in the ground, typically in a cement base, while a training box is typically a portable device that is placed on the ground.

Prior art training boxes typically include a bottom and a front edge or lip that make them suitable for practicing techniques that involve dropping the end of the vaulting pole when the pole approaches the training box onto the surface of the training box bottom. However, the edge at the front end of the box makes it undesirable for use by pole vaulters who prefer to slide their pole on the ground as they approach the box. Further, the front edge may act as an obstacle or barrier in cases where a pole vaulter, when approaching the box, unintentionally drops his or her pole early, before reaching the training box, and slides the pole along the ground and into the box. In such cases, the pole will strike the edge and this may result in pole vibration or other negative consequences.

Thus, it would be desirable to provide a training box that doesn't have a front edge.

SUMMARY

The subject invention is a training box or device used when an athlete trains or practices pole vaulting. The interior region of the training box is open, i.e. the base of the training box does not cover the interior of the device and thus there is no front edge. This invention is used to teach and train pole vaulters who prefer to slide their vaulting poles on the ground instead of using the prevailing method which involves carrying a pole as they run towards the box and placing the tip of the pole onto the surface in the interior of the training box.

In certain embodiments, the subject invention includes an electronics capability for measuring performance characteristics of pole vaulters. Such embodiments incorporate electronic elements that enable the subject invention to determine the speed of a pole during the period when it is within box.

In certain embodiments, the training box includes a rear wall that has an inside and an outside, a left side wall, which has a front end and a rear end, and an inside and an outside, and a top and a bottom, which fastens at the rear end to the rear wall, a right side wall, which has a front end and a rear end, and an inside and an outside and a top and a bottom, which fastens at the rear end to the rear wall, and wherein the inside of the left wide wall, the inside of the right side wall and the inside of the rear wall, define a V-shaped interior region that has a front opening, and a flat base to which the bottoms of the rear wall, left side wall and right side wall fasten, and where the base extends outward from the outsides of the rear wall, left side wall and right side wall and does not extend into the interior of the V-shaped region.

In certain embodiments, the training box further includes an electronics unit that includes nontransitory memory for storing program code and data, a processor, an optical sensor configured to determine when a pole passes by it in the interior of the V-shaped region, and a near field communications transceiver, an acceleration sensor to determine the time when a pole strikes against the backstop, an audio speak, an on/off switch, and a battery and a housing.

BRIEF DESCRIPTION OF DRAWINGS

Non limiting and non exhaustive embodiments of the present invention are described with reference to the following drawings. In the drawings, like reference numerals refer to like parts throughout the various figures unless otherwise specified.

The figures depict embodiments of the present invention for purposes of illustration only. One skilled in the art will readily recognize from the following discussion that alternative embodiments of the structures and methods illustrated herein may be employed without departing from the principles of the invention described herein.

DETAILED DESCRIPTION

The invention now will be described more fully hereinafter with reference to the accompanying drawings, which form a part hereof, and which show, by way of illustration, specific exemplary embodiments by which the invention may be practiced. This invention may, however, be embodied in many different forms and should not be construed as limited to the embodiments set forth herein; rather, these embodiments are provided so that this disclosure will be thorough and complete, and will fully convey the scope of the invention to those skilled in the art. Among other things, the invention may be embodied as methods, processes, systems, or devices. The following detailed description is, therefore, not to be taken in a limiting sense.

As used herein the following terms have the meanings given below:

Training box, pole vault training box, or box—refers to a device used in the training of and practice by pole vaulters. The training box is typically placed on the ground and serves as a target for pole vaulters when practicing their approach with a pole.

Front edge, front lip, edge or lip, refers to an edge of a bottom portion of prior art training boxes that is at the front of the training box and which would be struck by a pole if the pole is dragged on the ground prior to reaching the training box. The subject invention does not include such a front edge.

The subject invention is a training box or device used when an athlete trains or practices pole vaulting. This invention is used to teach and train athletes pole vaulters who prefer to, or who unintentionally, slide their vaulting poles on the ground instead using the prevailing method which involves carrying a pole as they run towards the box and placing the tip of the pole inside the training box. In contrast to prior art practice boxes, the subject invention does not have a bottom, or a front edge. Thus, the invention does not offer any resistance and does not impede the tip of a pole in any way from sliding into the training box and contacting a wall at the back of the device. Because the subject invention is bottomless and exposes the surface it is laid, a pole can slide on that surface and into the wall at the back of the the invention.

Figure 1A:
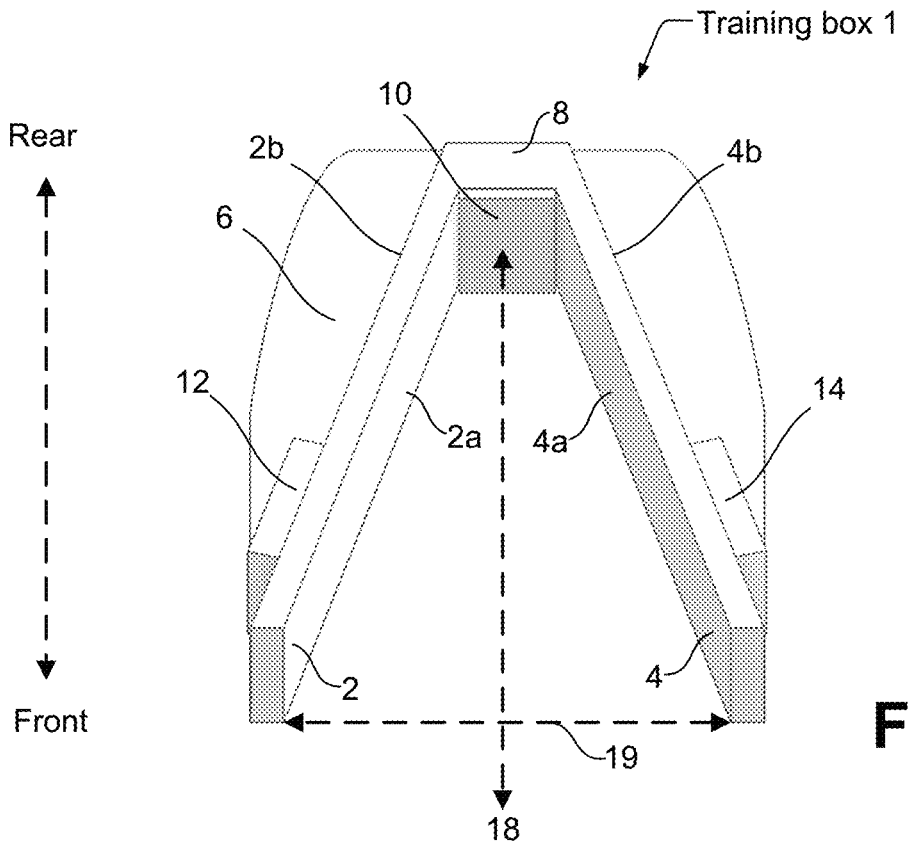
FIG. 1A illustrates a front isometric view of an embodiment of a training box used to train pole vaulters, which does not include a bottom or a front edge.

FIG. 1A illustrates a front isometric view of an embodiment of a training box 1 used to train pole vaulters, which does not include a bottom or a front edge. Box 1 has a left side wall 2, a right side wall 4, a base 6, and a rear wall 8. Left side wall 2 has a left side wall inside 2*a* and a left side wall outside 2*b*. Right side wall 4 has a right side wall inside 4*a* and a right side wall outside 4*b*. Base 6 has a bottom side that rests flat on the ground or on a ground cover and a top side that faces upward. Each of side walls 2 and 4 has a front end and a rear end. The rear ends of side walls 2 and 4 each attach to rear wall 8.

Box 1 is right-left symmetric with reference to an axis 18 that travels mid-way between the two side walls 2 and 4, through the center of rear wall 8. The two side walls 2 and 4 and rear wall 8 define a generally V-shaped region that has an interior and an exterior and a front opening 19. The interior of the V-shaped region may also be referred to as the interior of box 1; and the exterior of the V-shaped region may also be referred to as the exterior of box 1.

In certain embodiments, walls 2, 4 and rear wall 8 mount on top of base 6. In other embodiments, left side wall 2 and right side wall 4 fasten to rear wall 8 and the three elements fasten to base 6. The method of fastening these elements depends on the materials used. However, generally, screws, bolts, nails, glue, side straps, brackets, dowel joints, miter cuts, bevel joints may be used.

In certain embodiments, box 1 includes a backstop 10 that absorbs impact from contact with a pole and thus reduces wear and tear from repeated impacts. Box 1 fastens to the inside of rear wall 8. Backstop 10 is typically constructed of rubber but may be made of any material that can cushion rear wall 8 from repeated impact from a pole vault.

Training box 1 can take on a variety of width and lengths while staying within the general shape of pole vault boxes typically used for track and field competitions. Such boxes are approximately three feet, or 90 cm in length from the front opening to the rear wall. However, since standards do not apply for training boxes any shape and size may be used. Acceptable sizes for box 1 may be in range of 1 to 3 feet wide by 2 to 4 feet long with 2 feet wide by 3 feet long being a preferred dimension. Side walls 2 and 4 and rear wall 8 are typically in the range of 3 to 12 inches high with 6-8 inches being a preferred range.

Side walls 2, 4, rear wall 8 and base 6 may be constructed of any material that can withstand shock including inter alia wood, plastic, rubber, metal, fiberglass, carbon fiber and ceramic.

In certain embodiments, a pair of inertial weights 12 and 14 fasten to side walls 2 and 4, preferably on their exterior sides. Thus, inertial weight 12 and 14 fastens to left side wall exterior 2*b* and inertial weight 14 fastens to right side wall exterior 4*b*. These inertial weights are typically added when additional resistance is desired by larger pole vaulters using training box 1. Inertial weights 12 and 14 typically fasten towards the front of the side walls to prevent undue movement of box 1 during use. Inertial weights 12 and 14 can have any weight practical, with a range of 1 to 20 lbs. being acceptable and a range of 5 to 10 lbs. being preferable. Inertial weights 12 and 14 are typically made of inter alia steel, lead, wood, or another relatively dense material.

Figure 1B:
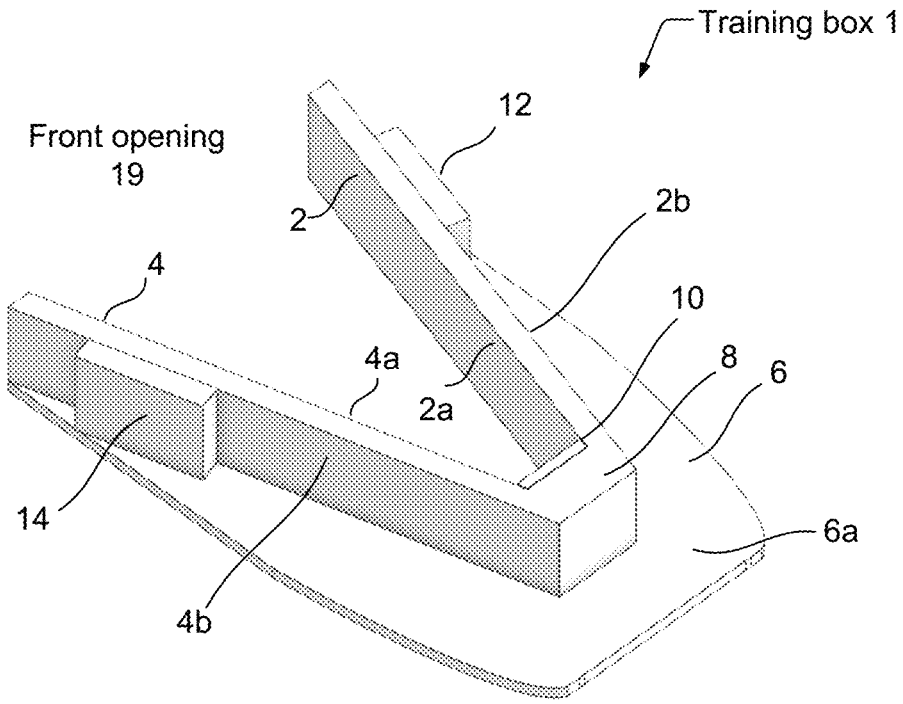
FIG. 1B illustrates a rear isometric view of the training box.

FIG. 1B illustrates a rear isometric view of training box 1, which is used to train pole vaulters, which does not include a bottom or a front edge. In certain embodiments, base 6 extends outward from side walls 2 and 4 and base 6. More specifically, as illustrated in FIG. 1B, box 1 has a rear lip 6*a* that extends outward, from the rear of rear wall 8. The outward extension of base 6 provides additional stability, beyond that of the V-shaped configuration of side walls 2 and 4 and rear wall 8 and serves to prevent box 1 from flipping over when it is struck by a pole. Typically, rear lip 6*a* extends 1 to 12 inches outward, i.e. towards the rear, from rear wall 8 with a preferred range of 3 to 5 inches outward. Generally, the outward extension serves to spread or equalize the weight of training box 1 over a larger surface area thus reduces any damage box 1 may cause to the surface on which it is used.

Figure 2:
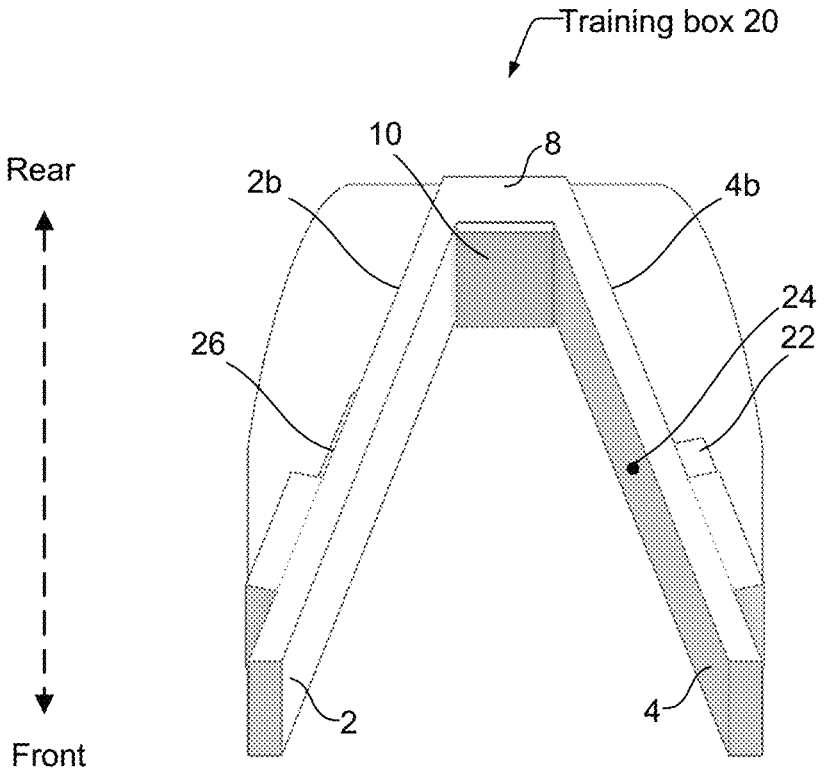
FIG. 2 illustrates a front isometric view of an embodiment of a training box used to train pole vaulters, which includes electronics capability for measuring performance characteristics of pole vaulters.

FIG. 2 illustrates a front isometric view of an embodiment of a training box 20 used to train pole vaulters, which includes electronics capability for measuring performance characteristics of pole vaulters. The characteristics of training box 20 are generally identical to those of training box 1 with the exception that it incorporates electronic elements that enable box 20 to determine the speed of a pole during the period when it is within box 20. Box 20 includes an electronics unit 22 that mounts to the exterior of one of side walls 2 or 4. A counterweight 26, to electronics unit 22, may be fastened to the opposite wall. Training box 20 includes a first sensor 24, that enables it to determine when a pole or other object passes in front of it, in the interior of box 20. The first sensor may be an optical sensor such as an infrared sensor, photoelectric sensor, a laser, or another technology. A second sensor 32 (illustrated in FIG. 3), such as an acceleration sensor, is provided that enables electronics unit 22 to determine when a pole strikes rear wall 8 or backstop 10. In certain embodiments, the first and second sensor may actually be a single sensor such as a photoelectric sensor.

Figure 3:
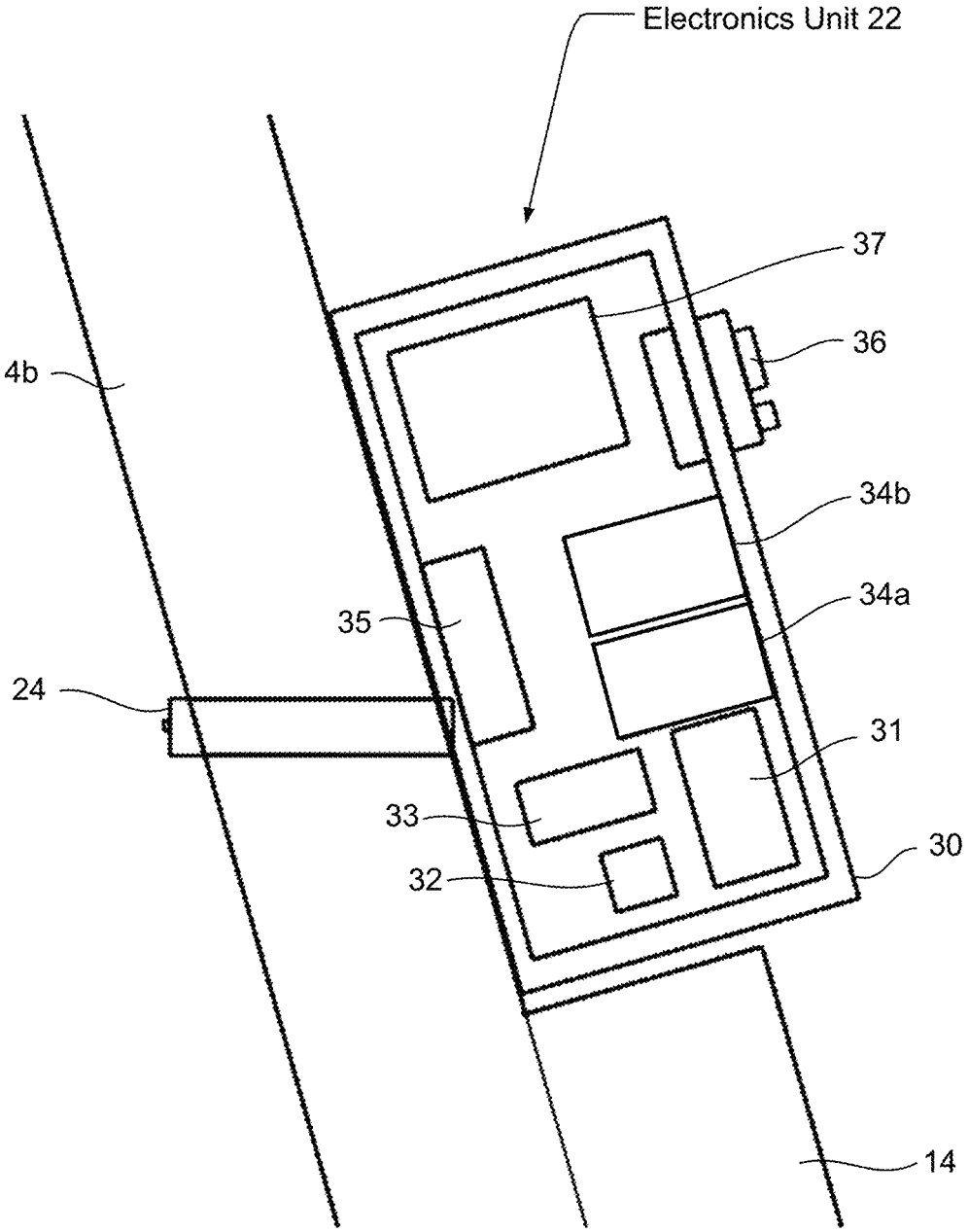
FIG. 3 illustrates an embodiment of an electronics unit.

As illustrated in FIG. 3, electronics unit 22 further includes a processor (31), second sensor 32, static, or nontransitory memory 34*a* for storing program code and data, dynamic memory 34*b*, a near field communications transceiver 33 such as Bluetooth or WiFi that enables it to communicate with an external device such as a mobile device, or personal computer, an audio speaker 35, an on/off switch 36, a battery 37 and a housing 30.

Generally, electronics unit 22 is capable of determining an event in which a pole passes in front of unit 22 and then the pole immediately strikes backstop 10. For each such event, unit 22 may compute inter alia characteristics such as the elapsed time, and the average speed of the pole during the event, i.e. when is the pole is in the interior of box 20. Upon detecting an event and determining the characteristics of the event, electronics unit 22 may be configured to communicate these characteristics to an external device using its near field communications capability.

Upon reading this disclosure, those of skill in the art will appreciate still additional alternative structural and functional designs through the disclosed principles herein. Thus, while particular embodiments and applications have been illustrated and described, it is to be understood that the disclosed embodiments are not limited to the precise construction and components disclosed herein. Various modifications, changes and variations, which will be apparent to those skilled in the art, may be made in the arrangement, operation and details of the method and apparatus disclosed herein without departing from the spirit and scope defined in the appended claims.

What is claimed is:

1. A training box for training pole vaulters, comprising:

a rear wall that has an inside and an outside;

a left side wall, which has a front end and a rear end, and an inside and an outside, and a top and a bottom, which fastens at the rear end to the rear wall;

a right side wall, which has a front end and a rear end, and an inside and an outside and a top and a bottom, which fastens at the rear end to the rear wall, and wherein the inside of the left side wall, the inside of the right side wall and the inside of the rear wall, define a V-shaped interior region that has a front opening;

a first inertial weight that attaches to the outside of the left side wall;

a second inertial weight that attaches to the outside of the right side wall, and wherein the first inertial weight and the second inertial weight have roughly the same weight; and a flat base to which the bottoms of the rear wall, left side wall and right side wall fasten, and wherein the base extends outward from the outsides of the rear wall, left side wall and right side wall, and wherein no portion of the training box covers the interior of the V-shaped region.

2. The device of claim 1 wherein the first inertial weight and the second inertial weight each have a weight with a range of 1 to 20 lbs.

3. The device of claim 1 wherein a distance from the rear wall to the front opening of the V-shaped region is in a range of 2 to 4 feet and a distance of the front opening between the two side walls is in a range of 1 to 3 feet.

4. The device of claim 1 wherein the base extends outward from the rear wall in a range of one to twelve inches.

5. The device of claim 1 further comprising:

a backstop that fastens to the inside of the rear wall, which cushions the rear wall from an impact of a pole vault.

6. The device of claim 5 wherein the backstop is made of rubber.

7. The device of claim 5 further comprising:

an electronics unit, comprising:

nontransitory memory for storing program code and data;

a processor;

a first sensor configured to identify when a pole passes by it in the interior of the V-shaped region; and a near field communications transceiver; and a second sensor configured to determine the time when the pole strikes against the backstop.

8. The device of claim 7 wherein the program code, when executed by the processor:

identifies an event where the pole first enters the interior of the V-shaped region and then strikes against the backstop; and determines an average speed of the pole during the event.

9. The device of claim 8, wherein the program code is configured to communicate the average speed, using the near field communications transceiver, to an external device.

10. The device of claim 7 wherein the near field communications transceiver is a wireless transceiver.

11. The device of claim 7 wherein the near field communications transceiver is a WiFi transceiver.

12. The device of claim 7 wherein the first sensor is an optical sensor.

13. The device of claim 7 wherein the second sensor is an acceleration sensor.

14. The device of claim 7 further comprising:

a housing;

a battery;

an audio speaker; and an on-off switch.

* * * * *